United States Patent [19]

Petersen

[11] Patent Number: 4,657,439

[45] Date of Patent: Apr. 14, 1987

[54] BUOYANT MEMBER RISER TENSIONER METHOD AND APPARATUS

[75] Inventor: William H. Petersen, Kingwood, Tex.

[73] Assignee: Shell Offshore Inc., Houston, Tex.

[21] Appl. No.: 810,126

[22] Filed: Dec. 18, 1985

[51] Int. Cl.[4] ..... E21B 19/00

[52] U.S. Cl. ..... 405/200; 405/195; 405/171; 166/341; 166/366; 166/350

[58] Field of Search ..... 405/195, 171, 200; 166/350, 359, 341, 366, 367; 175/7, 9, 10

[56] References Cited

U.S. PATENT DOCUMENTS

| | | | |
|---|---|---|---|
| 3,729,756 | 5/1973 | Cook et al. | 166/350 |
| 3,911,688 | 10/1975 | Behar et al. | 405/171 |
| 4,047,579 | 9/1977 | Wilckens et al. | 175/7 |
| 4,174,011 | 11/1979 | Zaremba | 175/7 |
| 4,422,801 | 12/1983 | Hale et al. | 405/195 |
| 4,477,207 | 10/1984 | Johnson | 405/195 |

*Primary Examiner*—Cornelius J. Husar
*Assistant Examiner*—Kristina I. Hall

[57] ABSTRACT

A method and apparatus is set forth in the present invention for supporting the weight of a marine riser by use of a passive tensioning system which utilizes a buoyant member located upon the upper end of the riser. The member has a vertical slot defined through its side such that the riser may access the member from a lateral direction. Such lateral access of the riser to the member allows these buoyant members to be changed from beneath the riser when maintenance and/or inspection is required on a particular member.

Since the riser need only to move laterally to access any member, and the riser may be temporarily supported at the surface by other means, the lower end of the riser does not need to be disconnected from subsea equipment when maintenance and/or inspection operations are required on a buoyant member. Well operations do not need to be interrupted, therefore, during buoyant member maintenance operations.

19 Claims, 8 Drawing Figures

BUOYANT MEMBER RISER TENSIONER METHOD AND APPARATUS

BACKGROUND OF THE INVENTION

1. Field of the Invention

This invention relates to drilling and producing wells underwater and particularly to supporting a marine riser extending upwardly from the bottom of a body of water.

2. Description of the Prior Art

In recent years the search for oil and gas has extended into increasingly deeper waters. Economic considerations and physical limitations frequently militate against the use of bottom supported platforms in very deep water. Therefore, most offshore drilling and production in deep water is conducted from a floating drilling or production platform which supports the drill rig and derrick and associated drilling equipment and/or production equipment. A marine riser is normally used to interconnect the floating platform and the subsea equipment such as a wellhead located upon the seafloor.

A marine riser may be employed in offshore operations to (1) guide tools and components into a well being drilled and to circulate drilling fluids and cuttings; (2) to convey fluids and tools from a floating vessel and a subsea installation, (i.e., subsea well, template, manifold, etc.) The marine riser is presently regarded as the limiting element in floating drilling operations and/or production operations since the weight of the marine riser and the stresses within the riser increase with water depth. Adding to the stress on the marine riser are bending moments caused by the action of wind, wave and sea currents on the riser and by movements of the floating platform.

To counteract marine riser stress, riser tensioning devices are normally mounted on the floating drilling or production platform. These tensioning devices apply a tensile force to the top of the marine riser, thereby reducing bending stresses on the riser. The use of flexible joints placed at the ends of the riser has also been used to increase riser flexibility. However, both riser tensioning devices and flexible joints have limitations as to the amount of riser stress which they can relieve.

Riser tensioning systems may be divided into "active" and "passive" systems. Active riser tensioning systems using hydraulically-driven piston and cylinder tensioners or other means (i.e., elastomeric springs) are subject to mechanical failure. Such failure may cause the marine riser assembly to collapse, severely damaging the subsea equipment and/or causing an underwater blowout with subsequent pollution and risk of danger to the floating platform, its equipment and crew. As noted in other patents, a passive riser tensioning system may be employed to avoid the problems of an active riser tensioning system. One form of a passive riser tensioning system comprises at least one buoyant member, such as a buoyancy chamber, or shaped foam floatation sections attached near the upper end of the marine riser in order to apply upward buoyant force to the riser. Use of such buoyant members decreases the amount of tensioner equipment that must be carried by the floating platform and eliminates tension reaction forces from the vessel thus reducing the vessel's buoyancy requirements.

As shown for example, in U.S. Pat. No. 3,017,934 entitled "Casing Support" issued Jan. 23, 1962, to A. D. Rhodes et al, a series of buoyant members may be attached around the periphery of the marine riser in order to supply the upward buoyancy necessary to apply tension to the riser. As shown in patent '934 however, the buoyancy members or tanks terminate some distance below the floating platform. Maintenance on these buoyancy members requires that the marine riser be disconnected from the subsea equipment, or that underwater operations be conducted in order to repair and/or inspect the submerged members. Each buoyant member must also be attached in a tedious manner to the riser as the riser is being assembled and lowered downwardly to the subsea equipment.

Each time that it becomes necessary to inspect one of these buoyant members, production from the subsea equipment must be interrupted and the riser disconnected from the subsea equipment in order to allow the riser buoyant member(s) to be removed to the surface. Accidental or emergency disconnection of the riser from the subsea equipment would expose the floating platform positioned above the riser to damage from the upwardly surging riser, with attendant risk to the crew of the platform.

A method and apparatus therefore need be developed that allows a riser to be passively tensioned by a buoyant member, without the inherent disadvantages mentioned previously in the use of such a member. A method and apparatus need be developed that permits maintenance operations on such a member without disrupting normal use of the marine riser. Such a member must be capable of easy removal from the riser in order to simplify the removal and/or inspection process of the member. The member should also be capable of easy attachment to the riser as the riser is assembled and/or connected to the subsea equipment.

SUMMARY OF THE INVENTION

The apparatus of the subject invention comprises a buoyant member having a vertical slot defined longitudinally through a portion of the member. The slot is formed to allow the riser to be passed through this slot and subsequently centered relative to the center of buoyancy of the member. A landing shoulder formed about the upper portion of the riser contacts the upper surface of the buoyant member and thereby transfers the buoyancy of the member to the riser, or from the perspective of the member transfers the weight of the riser to the member. The buoyancy of the member may be fixed or optionally adjusted to apply any desired upward tension to the riser.

During transfer of the riser to the buoyant member slot, lift means carried by the floating platform supply an upward tension to the riser sufficient to position the riser's landing shoulder at least above the upper surface of the buoyant member. At the time that the riser is being positioned within the vertical slot and its weight subsequently transferred to the member, the riser may remain suspended downwardly from the lift means and not be connected to any subsea equipment located upon the seafloor. The buoyancy member may be in a fully raised position when the disconnectd riser is engaged with the member. In this case, the riser and component at its lower end must be heavier than the buoyancy provided in order to allow the riser to be lowered and connected.

Alternatively, the riser may be connected to subsea equipment at the time that the riser's weight is transferred from the lift means to the member. In this latter case to insure that the landing shoulder is positioned above the upper surface of the member, the member may be submerged a sufficient distance below the landing shoulder so that the upper surface of the member is located below the bottom surface of the landing shoulder.

In this manner the riser may be easily positioned within the buoyant member and by the addition of additional buoyancy to the member the member may then support the entire weight of the riser, the riser lift means subsequently being disconnected from the upper portion of the riser.

If it is desired to inspect or perform maintenance on the buoyant member the riser lift means may be connected to the top upper portion of the riser, and then the buoyancy of the buoyant member decreased sufficiently to sink the member a selected distance below the landing shoulder of the riser, in order to freely move the riser away from the buoyant member. Buoyancy may then be added to the buoyant member sufficient to surface the member for inspection and/or complete retrieval from the body of water for further inspection.

It is therefore an object of the present invention to provide an improved method and apparatus to support the weight of a riser suspended vertically from a floating platform downward through a body of water.

It is a further object of the invention to provide a passive riser tensioning apparatus that is easily inspected over the life of the floating platform. It is a further object of the present invention to provide a riser tensioning apparatus that is inherently safer and more economical to operate than the previously disclosed active riser tensioning systems which utilize pistons and hydraulic cylinders or other means to actively tension the upper end of a riser.

It is a feature of the present invention to use a buoyant member having a vertical slot defined longitudinally therethrough and positioned within a vertical opening defined through a floating platform and being capable of vertical movement therein, to support the weight of an elongated vertical marine riser, the marine riser provided with connection means at its lower end for connection of the lower end to subsea equipment fixedly anchored to the seafloor and landing shoulder means connected to the upper portion of the riser having an outer dimension greater than the width of the vertical slot of the buoyant member.

These and other features, objects and advantages of the present invention will become apparent from the following detailed description, wherein reference is made to the figures in the accompanying drawings.

DESCRIPTION OF THE PREFERRED EMBODIMENT

Figure 1:
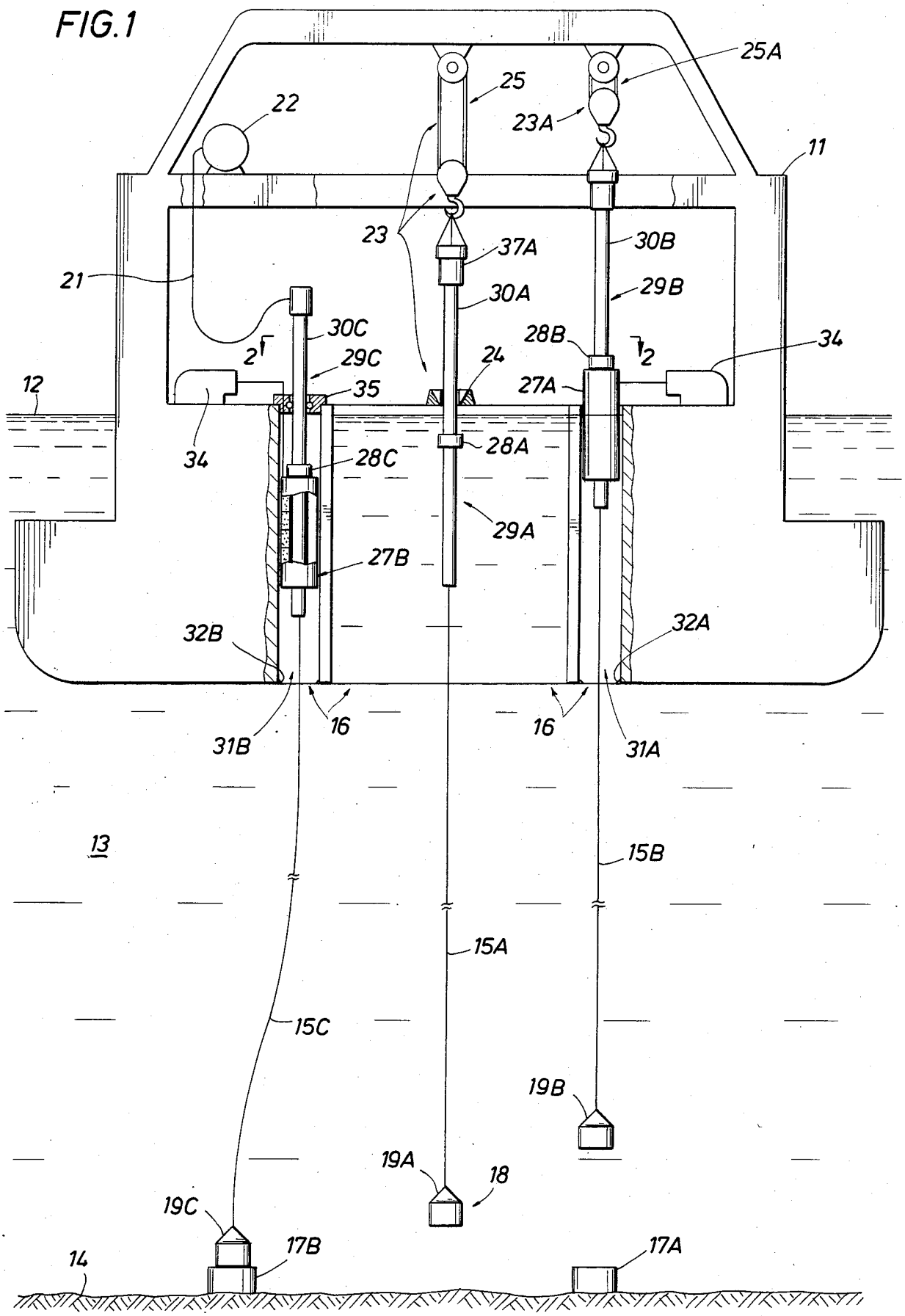
FIG. 1 is a schematic representation in side view showing several steps in the process of supporting several marine risers from several buoyant members.

Referring now to FIG. 1 a floating platform 11 is shown floating upon the surface 12 of a body of water 13 having a particular seafloor 14. Marine risers 15A, B, C are shown depending downwardly from a vertical opening 16 defined upwardly through platform 11 to subsea equipment 17A, B such as a wellhead well known to the art, the lower end 18 of marine riser 15A provided with connection means 19A for connection of the riser to subsea equipment 17. Connection means 19B, C are also shown provided at the lower ends of marine risers 15B, C, respectively. Flexible flowlines 21 place the upper end of marine riser 15C in fluid communication with production equipment 22 carried by the floating platform 11. The flexible flowlines may be those manufactured for example by COFLEXIP INC. (23 Avenue de Neville, 75116 Paris, France) and allow the marine riser 15C to move relative to floating platform 11 while still maintaining a flow of fluids from the riser 15C to the platform 11 equipment 22. It should be well understood that whereas production equipment 22 is shown located upon the floating platform 11 the marine risers 15A–C may also be used for drilling operations or any other subsea operations well known to the art.

Riser assembly and support means 23, 23A comprising slips 24 used in conjunction with lift means 25, 25A such as a crane well known to the art are used during the assembly of risers 15A–C and also to support the weight of the risers 15A, B, and C.

Buoyant members 27A, B are shown in various stages used to support the weight of risers 15B, C, respectively. Landing shoulder means 28A, B, C such as an outwardly-extending flange well known to the art are shown connected to the upper portions 29A, B, C of risers 15A, B, C, respectively. In a preferred embodiment, these upper portions 29A, B, C may take the form of riser extensions 30A, B, C formed to carry the landing shoulder means 28A, B, C, and to readily connect portions of the riser assembly and support means 23, 23A to the upper portions 29A, B, C of risers 15A–C, though it is well recognized that standard marine riser 15A, B, C sections may also be modified to accomplish the same mechanical results.

Buoyant members 27A, B are shown positioned within portions of the vertical opening 16 which forms buoyant member openings 31A, B, respectively. Lower stop means 32A, B such as inwardly extending annular shoulders prevent buoyant tanks 27A,B from falling out of the buoyant tank openings 31A,B when the tanks 27A,B obtain negative buoyancy. Buoyancy adjustment means 34 such as a pump well known to the art with associated piping, is capable of adding buoyancy means to and/or removing buoyancy means from buoyant members 27A, B.

A guide cap assembly 35 is positioned over buoyant member opening 31B after buoyant member 27B supports the weight of marine riser 15C as explained in more detail later.

Figure 2:
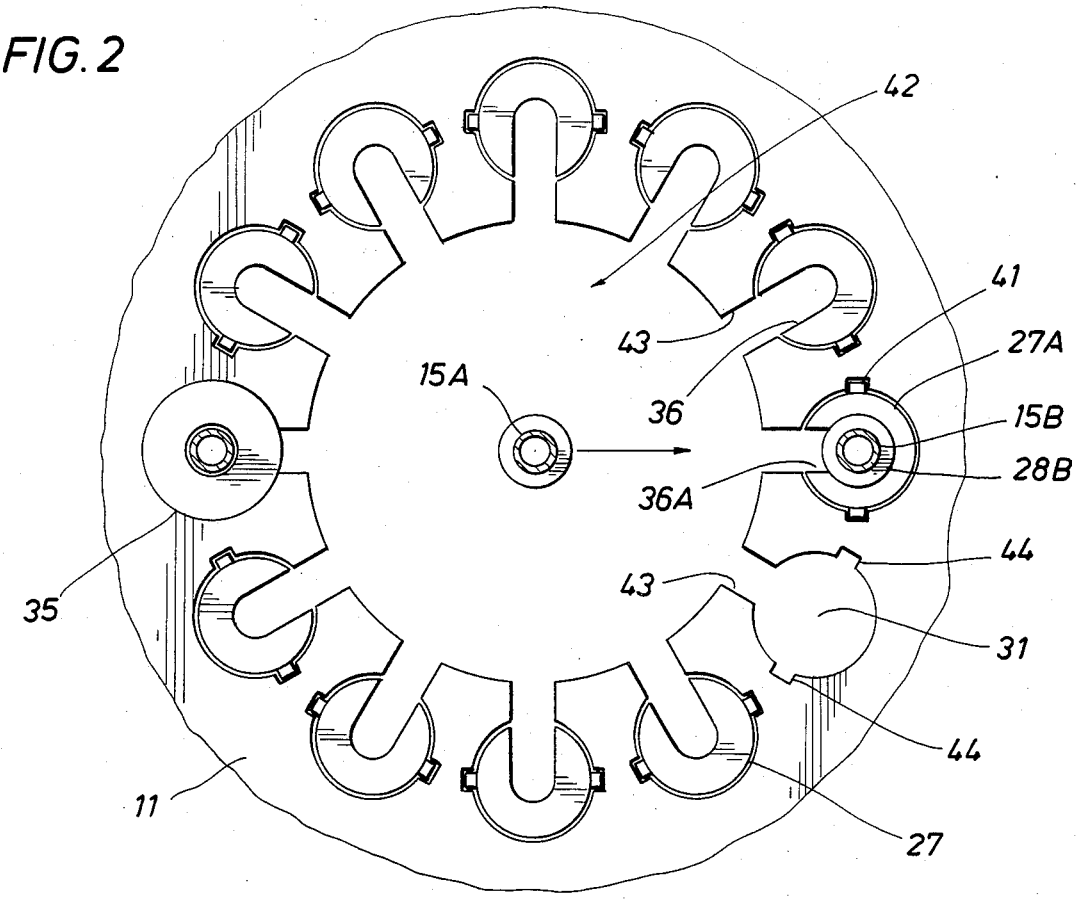
FIG. 2 is a schematic representation taken along lines 2—2 of FIG. 1 of a plan view of an array of buoyant members positioned radially outward from a central moon pool opening defined upwardly through the floating platform.

Referring now to FIGS. 1 and 2 the method of supporting the weight of an elongated vertical marine riser in a body of water by use of a buoyant member having a vertical slot 36A defined longitudinally downward through the member may be explained in further detail. As shown in FIG. 1 and by way of explanation marine riser 15A has just been assembled by the riser assembly and support means 23 and remains connected at its upper end 37A to lift means 25. The marine riser 15A can be seen to be positioned within the vertical opening 16 defined downwardly through the floating platform 11 and can be seen to be supported at its upper end 37A by a portion of the riser assembly and support means 23. Marine riser 15A is shown extending in tension substantially centrally down through the vertical opening 16 to a point adjacent the seafloor 14.

The method of support of the weight of risers 15A, B, C may be seen to comprise the steps of moving riser 15A towards and subsequently into the vertical slot 36A formed through the buoyant member 27A. For purposes of clarity, marine riser 15B is shown in this position in FIG. 1. After the riser 15B has been moved into vertical slot 36A buoyancy means such as a fluid having a positive buoyancy in water, or air, or any other gas well known to the art may be added from the buoyancy adjustment means 34 to the buoyant member 27A in a sufficient amount to increase the buoyancy of the member sufficiently to support the entire weight of the riser 15B. It should be well understood of course for the buoyancy member 27A to support the weight of riser 15B the landing shoulder means 28B connected to the upper portion of the riser 15B must have an outer dimension greater than the width 38 (FIG. 4) of the vertical slot 36A of buoyant member 27A.

More specifically, in a preferred embodiment the previous method may include, subsequent to the step of moving the riser 15 towards and subsequently into the vertical slot 36A formed through the buoyant member 27A, the additional steps of lowering the riser 15B by operation for example of lift means 25A, contacting the landing shoulder means 28B to the upper surface 39 (FIG. 3) of the buoyant member 27A, further lowering the riser 15B and the buoyant member 27A downwardly through the body of water 13, contacting the connection means 19B carried at the lower end 18 of the riser 15B to the subsea equipment 17A which is fixedly anchored to the seafloor 14, and thereafter connecting the connection means 19B to the subsea equipment 17A.

Prior to contacting the connection means 19 to the subsea equipment 17 it is realized of course that the connection means 19 must be positioned relatively centrally above the subsea equipment 17.

Depending upon the relative elevation of the landing shoulder means 28 relative to the buoyant member 27 in any particular assembly sequence it may be necessary to actuate the lift means 25 of the riser assembly and support means 23 a distance sufficient to lift the landing shoulder means 28 above the upper surface 39 of a particular buoyant member 15. As discussed later, if a buoyant member 27 is submerged to the bottom of the buoyant member opening 31, the previous two steps may not be necessary. In particular, if connection means 19 is already connected to subsea equipment 17 then a particular buoyant member 27 must be lowered below the elevation of a particular landing shoulder means 28 in order for the riser 15 to fit through that particular member's 27 vertical opening 36.

More specifically, the method of supporting the weight of a marine riser 15 may further include, prior to the step of moving the riser 15 towards a particular buoyant member 27, the following steps. The outer vertical surface of a buoyant member 27 may first be formed in the shape of an elongated member having a particular outer shape and dimension, such as a cylinder, by means well known to the art. The outer vertical surface of the buoyant member 27 may then be provided with at least one vertical key guide 41. The vertical opening 16 may be divided into a central moon pool opening 42 that a particular riser 15 may be assembled within. At least one riser slot opening 43 may be connected to the moon pool opening 42 having a width greater than the width of the upper end of a riser 15 but less than the outer dimension of a particular buoyant member 27. At least one buoyant member opening 31 may be connected to the riser slot opening 43, the buoyant member opening 31 having a dimension greater than the width of the riser slot opening 43 and formed to allow vertical displacement of a buoyant member 27 within the opening 31. At least one key guide slot opening 44 may be connected to the buoyant member opening 31, having a width greater than the width of the vertical key guide 41 and formed to allow vertical displacement of the vertical key guide 41 within the key guide slot opening 44.

Each buoyant member opening 31 with its associated riser slot opening 43 may be spaced in a radial manner about the central moon pool opening 42 or located in other positions about the floating platform 11 in order to allow a multiplicity of risers 15 to be supported by a corresponding number of buoyant members 27.

In a preferred embodiment then after dividing the vertical opening 16 into the above openings 42, 43, 31, and 44 the installation of each buoyant member 27 may be explained in more detail. Each buoyant member 27 may first be positioned centrally above its respective buoyant member opening 31. Lift means 25 may be used for this purpose. The vertical key guide 41 may then be aligned with the key guide slot opening 44 and thereafter the buoyant member 27 may be lowered downwardly into the buoyant member opening 31 and the vertical key guide 41 into the key guide slot opening 44. The key guide 41 and key guide slot opening 44 may be positioned relative to the riser slot opening 43 so as to align the vertical slot 36 of a particular buoyant member 27 with a particular buoyant member's riser slot opening 43.

Figure 4:
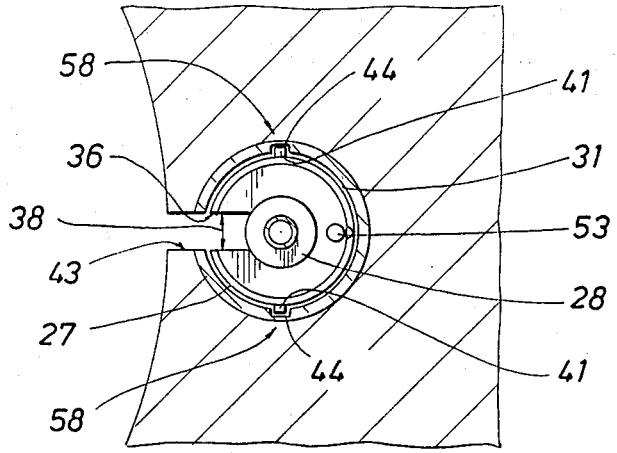
FIG. 4 is a schematic representation of a plan view taken along lines 4—4 of FIG. 3 of the buoyant member positioned within a buoyant members' opening and aligned with a riser slot opening by means of vertical key guides positioned within key guide slot openings.
Figure 3:
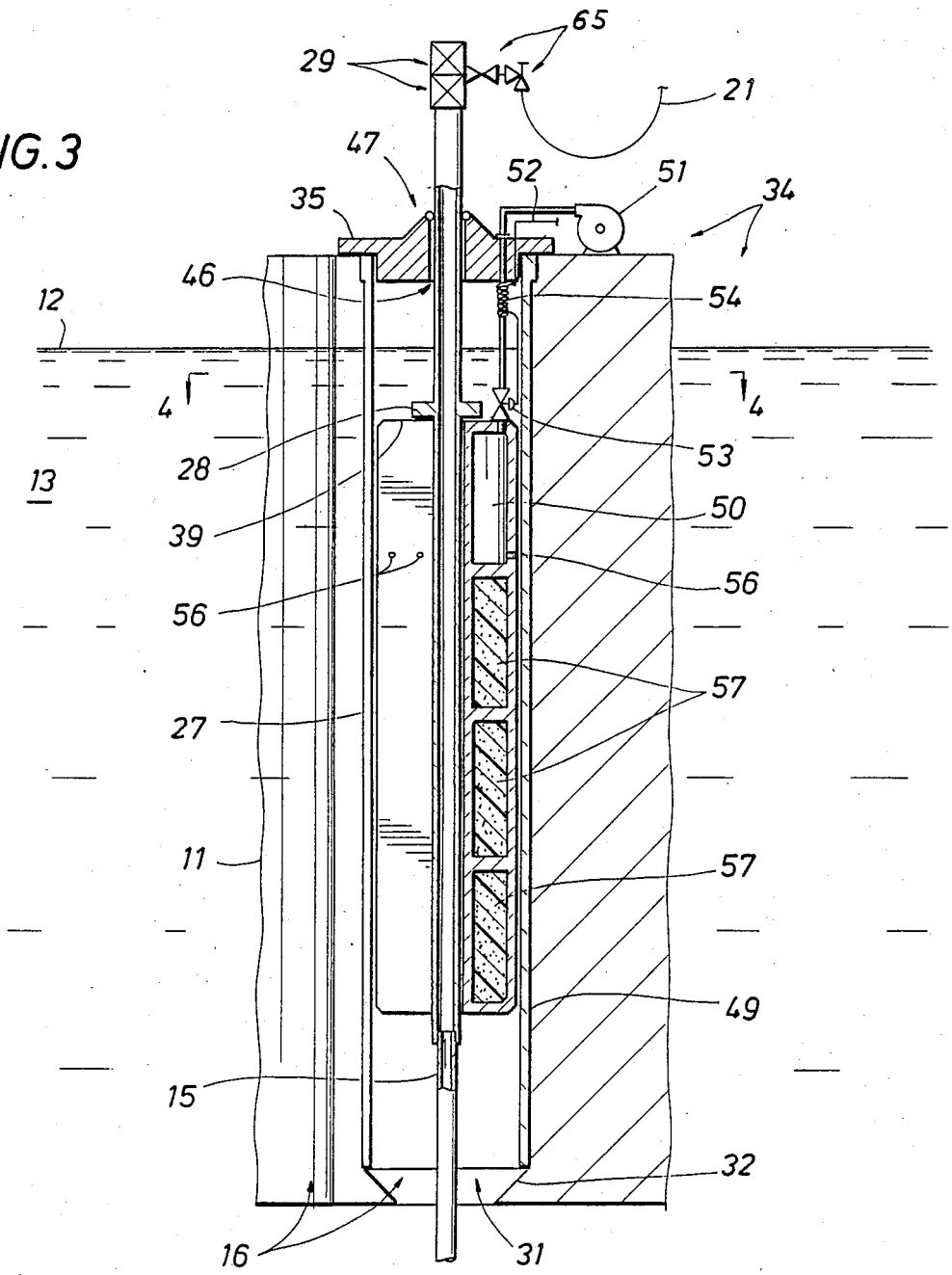
FIG. 3 is a schematic representation of a side view in partial cross section of a buoyant member shown supporting the weight of a marine riser.

Referring now to FIGS. 3 and 4 a particular buoyant member 27 supporting the weight of a riser 15 while moving vertically within buoyant member opening 31 of floating platform 11 is shown in more detail. Member 27 is positioned similar to member 27B shown in FIG. 1. It should be noted that after the landing shoulder means 28 contact the upper surface 39 of the buoyant member 27 and the weight of the riser 15 is subsequently transferred to the buoyant member 27, the member 27 will typically be fully immersed within the body of water 13 and therefore the guide cap assembly 35 may be placed about the upper portion of the riser above the landing shoulder means 28, the guide cap assembly 35 typically having an outer dimension greater than the outer dimension of the buoyant member opening 31, the guide cap assembly 35 carried at its lower end by the floating platform 11 and having a central opening 46 defined upwardly through the center of the assembly 35 thereof, the dimension of the opening 46 greater than the outer dimension of the upper portion of the riser 29. It is understood that the guide cap assembly 35 may be installed any time after the landing shoulder means 28 is lowered through the area that the guide cap assembly 35 will be positioned within.

The upper portion of the riser 29 of course is capable of vertical movement through the central opening 46 of the guide cap assembly 35. The guide cap assembly 35 may include roller means 47 such as rollers supported on bearings well known to the art connected to the guide cap assembly 35 and arranged circumferentially about the central opening 46. The roller means 47 are positioned so as to be rotatably engaged with the upper portion 29 of the riser 15 as the riser 15 moves relative to the floating platform 11 so as to center the riser 15 within the central opening 46. In this manner, the scuffing of the buoyant member 27 with a wear liner 49 that has been installed within the buoyant member opening 31 will be minimized.

It should be noted that the wear liner 49 may be fabricated and installed in such a manner that it may be replaced after incurring a sufficient amount of wear to cause abrasion to portions of the floating platform 11.

The buoyancy member 27 may be designed and fabricated to provide a fixed amount of buoyancy or it may have a certain amount of fixed buoyancy plus variable buoyancy. In a preferred embodiment, the buoyant member 27 is shown having at least one buoyancy chamber 50 capable of receiving air or gas from pump 51 which forms a portion of the buoyancy adjustment means 34. Addition or removal of buoyancy means such as air or any other suitable medium having a specific gravity less than that of water may be controlled by use of control line 52 connected to control valve 53 by other means well known to the art. Flexible conduit 54 such as a hydraulic line well known to the art is shown incorporated between control valve and guide cap assembly 35 in order to compensate for movement of the member 27 within the buoyant member opening 31. Vents 56 may be incorporated in the lower portion of buoyancy chamber 50 in order to allow the displacement of portions of the body of water 13 to and from the buoyancy chamber 50 as buoyancy means is added to or removed from the chamber 50.

In any event, the buoyancy adjustment means 34 should be capable of adding sufficient buoyancy means to the at least one buoyancy chamber 50 in order to allow the buoyant member 27 to support the entire weight of the riser 15.

It is well recognized that some form of buoyancy material 57 (i.e., polyurethane foam or syntactic foam) may be incorporated within buoyant member 27 in order to supply at least a minimum buoyancy to member 27 in the event of a failure of the buoyancy chamber 50 to supply at least a minimum buoyancy to member 27. Buoyancy members 27 may be; (1) evacuated metal or synthetic material tubes, (2) homogeneous buoyant material (i.e., foam, wood, etc.) or (3) combination of both. In this manner even if all buoyancy is lost from buoyancy chamber 50 the member 27 will not direct its entire structural weight upon the upper end of the riser 15. It should be well recognized of course that many different combinations of buoyancy chambers and/or syntactic foam may be used to accomplish the same mechanical result of supporting the weight of the riser 15. Buoyancy chamber 50 is shown at the upper section of member 27 in order to minimize the amount of hydrostatic pressure that must be overcome by the buoyancy adjustment means 34 in the process of forcing the buoyancy means within the buoyancy chamber 50. It should be well recognized also that the upper surface 39 of member 27 may be located above the surface 12 of the body of water 13 in order to position the control valve 53 above the surface 12, thereby minimizing its corrosion due to submersion within the body of water 13.

Flexible flowlines 21 are shown connected to flow control valves 65 which may take the form of well master control valves and associated flow choke valves well known to the art, used to control the flow of production fluids for example from the subsea equipment 17. As explained later, flexible flowlines 21 should be made long enough to allow movement of riser 15 from one buoyant member opening 31 to another.

Referring now to FIG. 4 it is well recognized that other vertical alignment means 58 may be incorporated between the member 27 and the floating platform 11 in order to maintain the vertical slot 36 of the member 27 properly oriented with respect to the riser slot opening 43. In a preferred embodiment the vertical alignment means 58 typically have a first and second portion, one of the portions of the alignment means 58 formed in the buoyant member 27 the other of the portions of the alignment means 58 formed in the floating platform 11 located adjacent the buoyant member 27. In the preferred embodiment shown in FIG. 4 the first portion of the vertical alignment means 58 comprises at least one vertical key guide 41 wherein the second portion of the alignment means 58 comprises at least one key guide slot opening 44 connected to the vertical opening 16 (FIG. 3), It is well recognized that many other various alignment means 58 may be used to accomplish the same mechanical result.

It must be remembered that in the discussion up to this point the method of supporting the weight of the riser comprised the general steps of moving a riser towards and subsequently into a vertical slot formed through a buoyant member and subsequently adding buoyancy means from buoyancy adjustment means to the buoyant members sufficient to support the entire weight of the riser. More specifically, in this discussion the lower end of the riser was not connected to the subsea equipment when the riser was moved within the vertical slot.

Referring now to FIGS. 5 through 8, however, the lower end of the riser 15 is shown connected to subsea equipment 17 fixedly anchored to the seafloor 14, before the riser 15 is moved within a buoyant member 27D. It should be well recognized that the lower end of the riser 15 may or may not be connected to its lower end 18 to subsea equipment 17 during the performance of the general steps of the method of the present invention.

Figure 5:
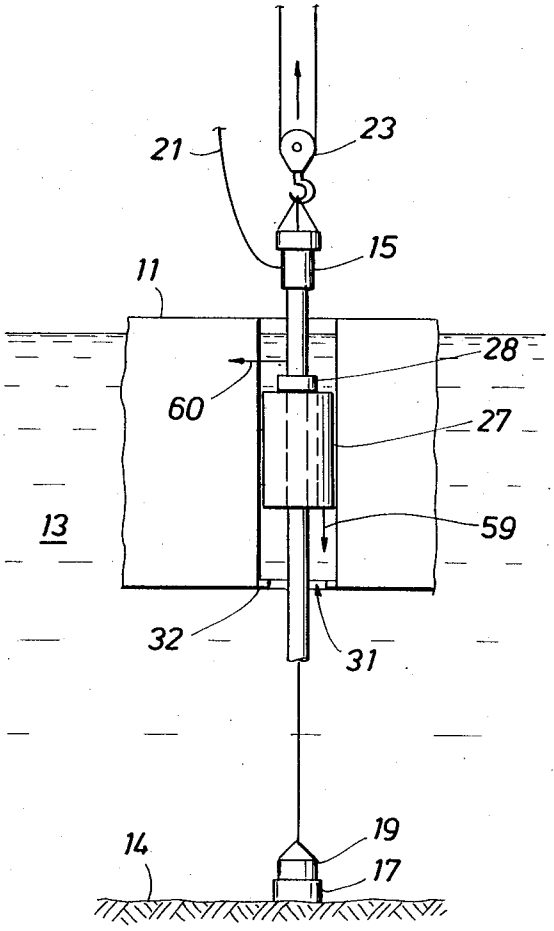
FIG. 5 is a schematic representation of a side view of a riser and buoyant member prior to commencement of maintenance operations on the buoyant tank.

Referring now to FIG. 5 it may be necessary at some point in time to perform maintenance operations on buoyant member 27. At this point in time the riser assembly and support means 23, previously disconnected from the upper portion of the riser 15 may be reconnected to the upper portion of the riser 15. The weight of the riser 15 may then be transferred to the riser assembly and support means 23. Buoyancy may then be removed from the buoyant member 27, which causes the member 27 to travel downward through the buoyant member opening 31 as indicated by arrow 59. Once the landing shoulder means are no longer carried by the buoyant member 27 the riser 15 may be moved from the buoyant member opening 31 as indicated by arrow 60. The riser 15 may be moved away from and subsequently out of the vertical slot 36B (FIG. 8) by use of the riser assembly and support means 23 if sufficient flexure exists along the entire length of riser 15 to allow movement of the upper portion of the riser 15 without requiring the movement of the floating platform 11. It is well recognized of course that the floating platform 11 may be moved relative to riser 15 to accomplish the same mechanical result.

Figure 6:
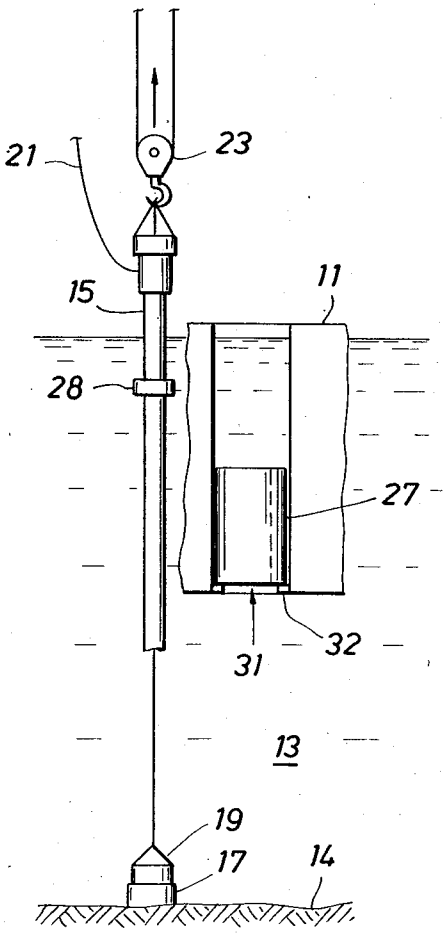
FIG. 6 is a schematic representation of a side view of the riser removed from the buoyant member vertical slot and the buoyant member submerged within the buoyant member opening.

Referring now to FIG. 6 upon removal of sufficient buoyancy from the buoyant member 27 the buoyant member 27 will sink downwardly through the body of water 15 until it is carried by lower stop means 32 provided at the lower end of the vertical opening forming the buoyant member opening 31. The lower stop means 32 prevent further downward movement of the buoyant member 27. The buoyant member 27 may be carried by the lower stop means 32 at least until the riser 15 has cleared away from the buoyant member opening 31.

Figure 7:
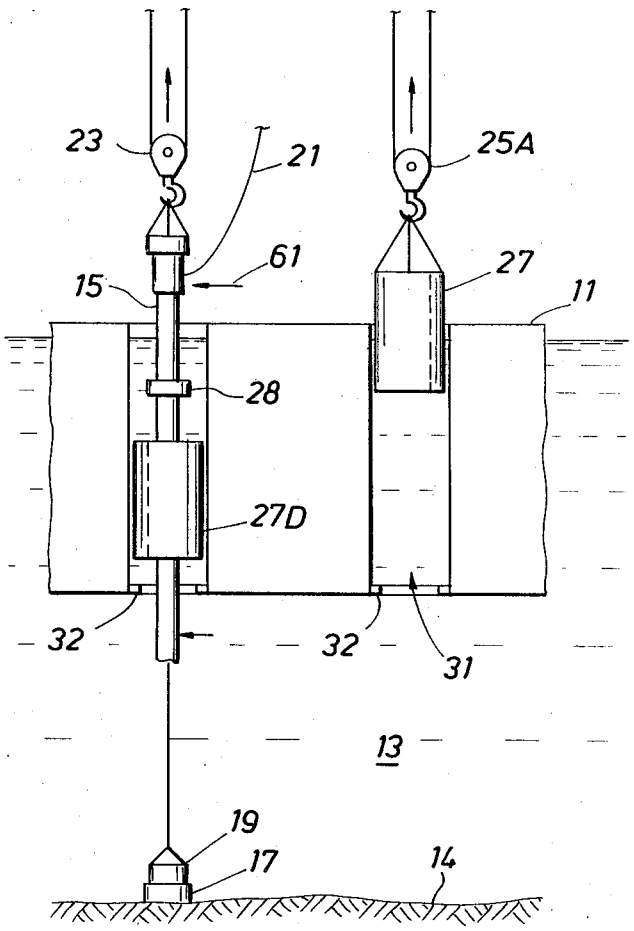
FIG. 7 is a schematic representation of a side view of the riser positoned within a vertical slot of an additional buoyant member, the original buoyant member being shown partially removed from the buoyant member opening.

Referring now to FIG. 7 sufficient buoyancy may now be added to the buoyant members 27 to allow removal of the member 27 from the buoyant member opening 31 which forms a portion of the vertical opening 16 (shown in FIG. 1). Lift means 25A (FIG. 1) such as a crane and hoist mechanism may be used to lift the member 27 from the buoyant member opening 31. The member 27 which forms the passive tensioning mechanism for the riser 15 may now have maintenance and/or inspection operations performed on the member 27 while production continues to flow from riser 15 through flexible flow lines 21. In any event, the key advantage of the use of this method is that the lower end of the riser need not be disconnected from the subsea equipment 17 in order to perform maintenance and/or inspection operations on the buoyant member 27. If the riser had to be disconnected each time that maintenance or inspection was required on a buoyant member 27 the resultant production from subsea equipment 17 would be lost sometimes for up to a period of one week, dependent upon the difficulty of reconnection of the lower end of the riser 15 with the subsea equipment 17. Each time that a disconnection and connection operation is conducted with the subsea equipment 17 the risk also exists that irreparable damage may result between both devices 17, 19 which would require full retrieval of a riser 15 from the body of water and subsequent underwater repair operations to be conducted upon the subsea equipment 17. The risk of this occurrence is eliminated by the use of the steps of this method.

While the buoyant member 27 is being inspected and/or subjected to maintenance operations the riser 15 may remain suspended from the riser assembly and support means 23, or alternatively in a preferred embodiment the riser 15 may be repositioned within an additional buoyant member 27D correspondingly having a vertical slot as before defined longitudinally downwardly through the member 27D, member 27D being similar to member 27. As shown in FIG. 7 the member 27D may be fully submerged and be carried upon the lower stop means 32 while the riser 15 is moved towards and subsequently into the vertical slot formed through the member 27D. Subsequent to locating the riser 15 within the slot additional buoyancy means may be added from the buoyancy adjustment means 34 (FIG. 1) to the member 27D sufficient to raise the member 27D upwardly through the buoyant member opening 31, into contact with the landing shoulder means 28 and sufficient to support the entire weight of the riser 15. At this point in time the riser assembly and support means 23 may be disconnected from the upper end of the riser 15.

Figure 8:
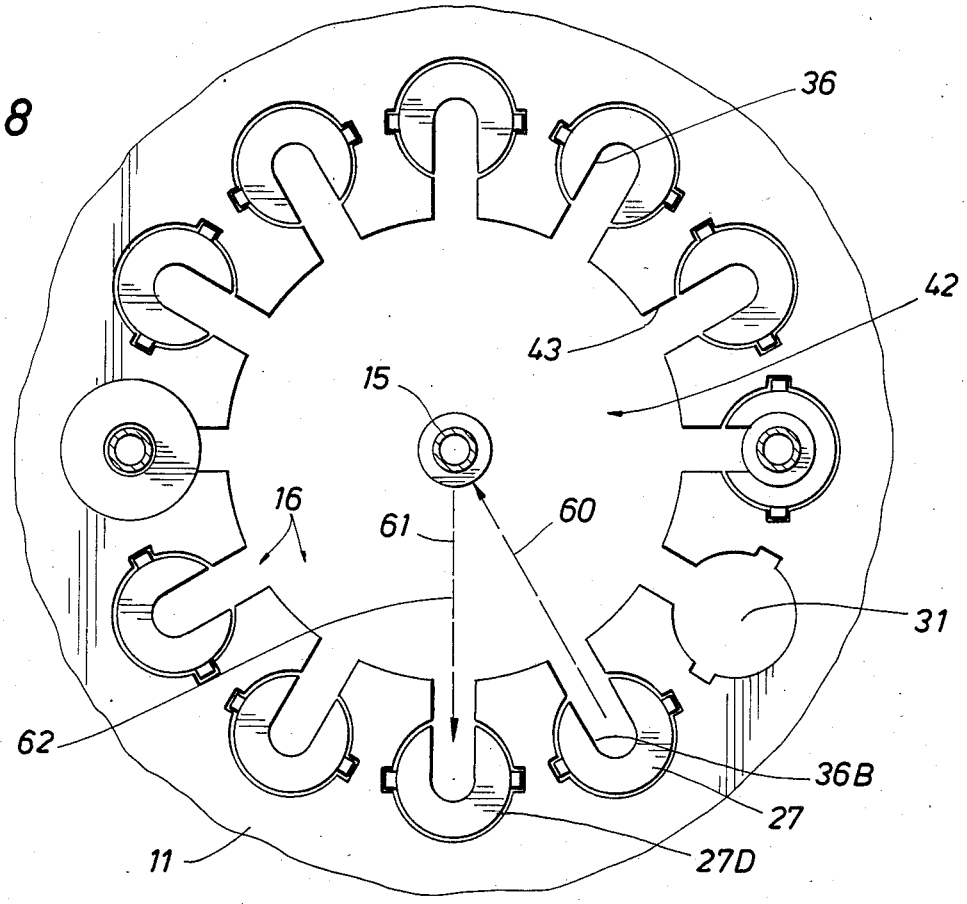
FIG. 8 is a schematic representation of a plan view showing the path of movement of the riser from the original buoyant member to the additional buoyant tank.

Referring now to FIG. 8 the path of movement 62 of riser 15 is indicated by arrows 60, 61 also shown in FIGS. 5 and 7. It should be well recognized that riser 15 may be positioned within any additional buoyant member shown within the vertical opening 16 of FIG. 8. Note also that while a buoyant member 27 is removed from buoyant member opening 31 the well liner 49 (shown in FIG. 3) may be easily removed from the opening 31 for repair and/or inspection.

It should be recognized that the weight of the riser 15 may be supported either by the steps set forth schematically in FIG. 1 where the riser 15 is not initially connected to the subsea equipment 17, or alternatively the riser 15 may be installed upon a buoyant member 27 as shown in FIG. 7 where the lower end of the riser 15 is connected to the subsea equipment 17 prior to the riser 15 being supported by the buoyant member 27D.

Many other variations and modifications may be made in the apparatus and techniques hereinbefore described, both by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

What is claimed is:

1. A method of supporting the weight of an elongated vertical marine riser in a body of water by use of a buoyant member having a vertical slot defined longitudinally therethrough, said buoyant member positioned within a vertical opening defined through a floating platform and being capable of vertical movement therein, said floating platform provided with;

riser assembly and support means for assembly of said riser and support of the weight of said riser, and buoyancy adjustment means for adjustment of the buoyancy of said buoyant member by the addition to and removal of buoyancy means from said buoyant member, said marine riser provided with;

connection means at its lower end for connection of said lower end to subsea equipment fixedly anchored to the seafloor of said body of water, and landing shoulder means connected to the upper portion of said riser having an outer dimension greater than the width of said vertical slot of said buoyant member, said marine riser positioned within said vertical opening and being supported at its upper end by a portion of said riser assembly and support means and extending in tension substantially centrally down through said vertical opening to a point adjacent said seafloor, said method of supporting the weight of said riser comprising;

moving said riser towards and subsequently into said vertical slot formed through said buoyant member, and adding buoyancy means from said buoyancy adjustment means to said buoyant member sufficient to support the entire weight of said riser.

2. The method of claim 1 including, subsequent to the step of moving said riser towards and subsequently into said vertical slot formed through said bouyant member, the additional steps of;

lowering said riser, contacting said landing shoulder means to the upper surface of said buoyant member, further lowering said riser and said buoyant member downwardly through said body of water, contacting said connection means carried at the lower end of said riser to said subsea equipment, and connecting said connection means to said subsea equipment.

3. The method of claim 1 including, prior to the step of moving said riser towards said buoyant member, the further steps of;

forming the outer vertical surface of said buoyant member in the shape of a cylinder having an outer dimension, providing the outer vertical surface of said buoyant member with at least one vertical key guide, dividing said vertical opening into;

a central moon pool opening, at least one riser slot opening connected to said moon pool opening having a width greater than the width of said riser upper end and less than the outer dimension of said buoyant member, at least one buoyant member opening connected to said riser slot opening having a dimension greater than the width of said riser slot opening and formed to allow vertical displacement of said buoyant member within said opening, and at least one key guide slot opening connected to said buoyant member opening having a width greater than the width of said vertical key guide and formed to allow vertical displacement of said vertical key guide within said key guide slot opening, positioning said buoyant member centrally above said buoyant member opening, aligning said vertical key guide with said key guide slot opening, and lowering said buoyant member downwardly into said buoyant member opening and said vertical key guide into said key guide slot opening, said vertical key guide and key guide slot opening positioned relative to said riser slot opening so as to align said vertical slot of said buoyant member with said riser slot opening.

4. The method of claim 1 including, prior to the step of moving said riser towards said buoyant member, the further steps of;

actuating said riser assembly and lift means, and lifting said landing shoulder means above the upper surface of said buoyant member.

5. The method of claim 2 including, prior to the step of contacting said connection means to said subsea equipment, the step of;

positioning said connection means centrally above said subsea equipment.

6. The method of claim 2 including, subsequent to the step of lowering said riser until said landing shoulder means contacts the upper surface of said buoyant member the step of;

placing a guide cap assembly about the upper portion of said riser above said landing shoulder means, said guide cap assembly having an outer dimension greater than the outer dimension of said buoyant member opening, said guide cap assembly carried at its lower end by said floating platform, said guide cap assembly having a central opening defined upwardly through the center thereof, the dimension of said opening greater than the outer dimension of the upper portion of said riser.

7. A method of supporting the weight of an elongated vertical marine riser in a body of water by use of a buoyant member having a vertical slot defined longitudinally therethrough, said buoyant member positioned within a vertical opening defined through a floating platform and being capable of vertical movement therein, said floating platform provided with;

riser assembly and support means for assembly of said riser and support of the weight of said riser, and buoyancy adjustment means for adjustment of the buoyancy of said buoyant member by the addition to and removal of buoyancy means from said buoyant member, said marine riser provided with;

connection means at its lower end for connection of said lower end to subsea equipment fixedly anchored to the seafloor of said body of water, and landing shoulder means connected to the upper portion of said riser having an outer dimension greater than the width of said vertical slot of said buoyant member, said marine riser positioned within said vertical opening and being supported at its upper end by a portion of said riser assembly and support means and extending in tension substantially centrally down through said vertical opening to a point adjacent said seafloor, said method of supporting the weight of said riser comprising;

forming the outer vertical surface of said buoyant member in the shape of a cylinder having an outer dimension, providing the outer vertical surface of said buoyant member with at least one vertical key guide, dividing said vertical opening into;

a central moon pool opening, at least one riser slot opening connected to said moon pool opening having a width greater than the width of said riser upper end and less than the outer dimension of said buoyant member, at least one buoyant member opening connected to said riser slot opening having a dimension greater than the width of said riser slot opening and formed to allow vertical displacement of said buoyant member within said opening, and at least one key guide slot opening connected to said buoyant member opening having a width greater than the width of said key guide and formed to allow vertical displacement of said key guide within said key guide slot opening, positioning said bouyant member centrally above said buoyant member opening, aligning said vertical key guide with said key guide slot opening, lowering said buoyant member downwardly into said buoyant member opening and said vertical key guide into said key guide slot opening, said vertical key guide and key guide slot opening positioned relative to said riser slot opening so as to align said vertical slot of said buoyant member with said riser slot opening, actuating said riser assembly and lift means, lifting said landing shoulder means above the upper surface of said buoyant member, moving said riser towards and subsequently through said riser slot opening and into said vertical slot formed through said buoyant member, lowering said riser, contacting said landing shoulder means to the upper surface of said buoyant member, placing a guide cap assembly about the upper portion of said riser above said landing shoulder means, said guide cap assembly having an outer dimension greater than the outer dimension of said buoyant member opening, said guide cap assembly carried at its lower end by said floating platform, said guide cap assembly having a central opening defined upwardly through the center thereof, the dimension of said opening greater than the outer dimension of the upper portion of said riser, further lowering said riser and said buoyant member downwardly through said body of water, positioning said connection means centrally above said subsea equipment, contacting said connection means carried at the lower end of said riser to said subsea equipment, connecting said connection means to said subsea equipment, and adding buoyancy means from said buoyancy adjustment means to said buoyant member sufficient to support the entire weight of said riser.

8. The method of claim 1 further including, subsequent to the step of adding buoyancy means from said buoyancy adjustment means to said buoyant member sufficient to support the entire weight of said riser, the step of;

disconnecting said riser assembly and support means from the upper portion of said riser.

9. The method of claim 1 further including, subsequent to the step of adding buoyancy means from said buoyancy adjustment means to said buoyant member sufficient to support the entire weight of said riser, the steps of;

removing buoyancy means from said buoyant member, transferring the weight of said riser from said buoyant member to said riser assembly and lift means, moving said riser away from and subsequently out of said vertical slot formed through said buoyant member by use of said riser assembly and lift means, and adding sufficient buoyancy means to said buoyant member to allow removal of said buoyant member from said vertical opening.

10. The method of claim 9 further including, subsequent to the step of removing buoyancy means from said buoyant member, the further step of;

sinking said buoyant member downwardly through said body of water in said vertical opening, providing buoyant member lower stop means at the lower end of said vertical opening to prevent further downward movement of said buoyant member, and carrying said buoyant member upon said lower stop means.

11. The method of claim 9 further including, subsequent to the step of moving said riser away from and subsequently out of said vertical slot, the further steps of;

providing an additional buoyant member having a vertical slot defined longitudinally therethrough, moving said riser towards and subsequently into said vertical slot formed through said additional buoyant member, and adding buoyancy means from said buoyancy adjustment means to said additional buoyant member sufficient to support the entire weight of said riser.

12. A method of supporting the weight of a marine riser in a body of water, said method comprising;

moving said riser towards and subsequently into a slot defined through a buoyant member, a portion of said slot defined through the center of buoyancy of said member, centering said riser within said slot relative to the center of buoyancy of said buoyant member, and transferring the weight of said riser to said buoyant member.

13. Apparatus for use in supporting the weight of an elongated marine riser suspended vertically downward from a floating platform through a body of water and connectable at its lower end to subsea equipment fixedly anchored to the seafloor, said platform floating upon the surface of said body of water and having a vertical opening defined downwardly therethrough, the upper end of said marine riser being positioned within a portion of said vertical opening, said apparatus for supporting the weight of said riser comprising;

a buoyant member having a vertical slot of a particular width defined longitudinally therethrough, said buoyant member positioned within a portion of said vertical opening and being capable of vertical movement therein, said member having at least one buoyancy chamber defined therein, said buoyant member formed substantially around the upper portion of said riser, landing shoulder means connected to the upper portion of said riser having an outer dimension greater than the width of said vertical slot of said buoyant tank, said landing shoulder means carried by the upper surface of said buoyant member and thereby transferring the weight of said riser to said buoyant member, and buoyancy adjustment means carried by said floating platform and placed in fluid communication with said at least one buoyancy chamber of said buoyant member, capable of adding sufficient buoyancy means to said at least one buoyancy chamber to allow said buoyancy member to support the weight of said riser.

14. The apparatus of claim 13 wherein the outer vertical surface of said buoyant member is formed in the shape of a cylinder.

15. The apparatus of claim 13 further including vertical alignment means having a first and a second portion, one of said portions of said alignment means formed in said buoyant member, the other of said portions of said alignment means formed in said floating platform located adjacent said buoyant member.

16. The apparatus of claim 15 wherein said first portion of said alignment means comprises at least one vertical key guide, and wherein said second portion of said alignment means comprises at least one key guide slot opening connected to said vertical opening having a width greater than the width of said vertical key guide and formed to allow vertical displacement of said key guide within said key guide slot opening.

17. The apparatus of claim 13 further including a guide cap assembly arranged about the upper portion of said riser above said landing shoulder means, said guide cap assembly carried at its lower end by said floating platform, said guide cap assembly having an outer dimension greater than the outer dimension of said portion of said vertical opening, said guide cap assembly having a central opening defined upwardly through the center thereof, said dimension of said central opening greater than the outer dimension of said upper portion of said riser, the upper portion of said riser capable of vertical movement through said central opening of said guide cap assembly.

18. The apparatus of claim 17 wherein said guide cap assembly further includes roller means connected to said guide cap assembly and arranged about said central opening, said roller means rotatably engaged with the upper portion of said riser as said riser moves relative to said floating platform so as to center said riser within said central opening.

19. Apparatus for use in supporting the weight of a marine riser in a body of water comprising;

a buoyant member having a slot defined therethrough, a portion of said slot defined through the center of buoyancy of said buoyant member, and landing shoulder means connected to the upper portion of said riser having an outer dimension greater than the width of said slot defined through said buoyant member, a portion of said landing shoulder means carried by the upper surface of said buoyant member to transfer the weight of said riser downward to said buoyant member.

* * * * *